US011788286B2

(12) United States Patent
Bixel

(10) Patent No.: US 11,788,286 B2
(45) **Date of Patent: *Oct. 17, 2023**

(54) ACOUSTIC PANELS FOR A CEILING SUSPENSION SYSTEM

(71) Applicant: Nut Shell LLC, Redmond, WA (US)

(72) Inventor: Douglas Allan Bixel, Redmond, WA (US)

(73) Assignee: Nut Shell LLC, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/050,651

(22) Filed: Oct. 28, 2022

(65) Prior Publication Data

US 2023/0148428 A1 May 11, 2023

Related U.S. Application Data

(63) Continuation of application No. 17/174,099, filed on Feb. 11, 2021, now Pat. No. 11,486,142.

(60) Provisional application No. 62/975,058, filed on Feb. 11, 2020.

(51) Int. Cl.

| | |
|---|---|
| ***E04B 9/34*** | (2006.01) |
| ***E04B 9/04*** | (2006.01) |
| ***E04B 9/28*** | (2006.01) |
| *E04B 9/06* | (2006.01) |

(52) U.S. Cl.

CPC ..... *E04B 9/345* (2013.01); *E04B 9/04* (2013.01); *E04B 9/28* (2013.01); *E04B 9/068* (2013.01)

(58) Field of Classification Search

CPC ... E04B 9/345; E04B 9/04; E04B 9/28; E04B 9/0435

See application file for complete search history.

(56) References Cited

U.S. PATENT DOCUMENTS

| | | | |
|---|---|---|---|
| 3,050,162 | A | 8/1962 | Zingone |
| 3,378,980 | A | 4/1968 | Blitzer |
| 3,797,192 | A | 3/1974 | De |
| 4,091,594 | A | 5/1978 | Yamashita |
| 4,658,562 | A | 4/1987 | Brugman |
| 9,328,510 | B1 | 5/2016 | Springer et al. |
| D839,080 | S | 1/2019 | Iellimo |

(Continued)

FOREIGN PATENT DOCUMENTS

| | | | |
|---|---|---|---|
| DE | 202015000968 | U1 | 5/2016 |
| EP | 2458103 | A1 | 5/2012 |

(Continued)

OTHER PUBLICATIONS

International Preliminary Report on Patentability dated Aug. 11, 2022 received in PCT/US2021/017705 (9 pages).

(Continued)

*Primary Examiner* — Adriana Figueroa
(74) *Attorney, Agent, or Firm* — Dorsey & Whitney LLP

(57) ABSTRACT

A ceiling suspension system that includes a plurality of acoustic panels that are configured to be installed or attached into openings of a grid formed by main runners and cross runners of the ceiling suspension system. The acoustic panels include a plurality of main blades that extend in the same direction as the main runners and cross blades that extend in the same direction as the cross runners. Two or more of the main blades comprise a kerf in a first lateral edge of each main blade. The kerf comprises a first slot and a second slot that form a stepped configuration.

18 Claims, 10 Drawing Sheets

(56) References Cited

U.S. PATENT DOCUMENTS

| | | | |
|---|---|---|---|
| D852,029 | S | 6/2019 | Imai et al. |
| 10,407,904 | B2 | 9/2019 | Gillette et al. |
| 10,508,444 | B2 | 12/2019 | Gillette et al. |
| 2002/0100248 | A1 | 8/2002 | D'Agata |
| 2005/0284081 | A1 | 12/2005 | Porter |
| 2006/0165482 | A1 | 7/2006 | Olberding |
| 2008/0155927 | A1 | 7/2008 | Wendt et al. |
| 2009/0173030 | A1 | 7/2009 | Gulbrandsen et al. |
| 2010/0139210 | A1 | 6/2010 | Nelson |
| 2015/0068135 | A1 | 3/2015 | Waters |
| 2020/0002942 | A1 | 1/2020 | Headley et al. |

FOREIGN PATENT DOCUMENTS

| | | | |
|---|---|---|---|
| FR | 1533073 | A | 7/1968 |
| FR | 2417600 | A1 | 9/1979 |
| GB | 669993 | A | 4/1952 |
| GB | 753450 | A | 7/1956 |
| GB | 1504881 | A | 3/1978 |
| GB | 2199348 | A | 7/1988 |
| WO | 2021163361 | A1 | 8/2021 |

OTHER PUBLICATIONS

International Search Report and Written Opinion dated Apr. 7, 2021 for international application PCT/US2021/017705.

ACOUSTIC PANELS FOR A CEILING SUSPENSION SYSTEM

RELATED APPLICATIONS

This application is a continuation of U.S. application Ser. No. 17/174,099, filed Feb. 11, 2021, and titled "ACOUSTIC PANELS FOR A CEILING SUSPENSION SYSTEM," which claims priority to U.S. Provisional Application No. 62/975,058, filed Feb. 11, 2020, and titled "ACOUSTIC PANELS FOR A CEILING SUSPENSION SYSTEM," each of which is incorporated herein by reference in its entirety.

TECHNICAL FIELD

The present disclosure relates generally to the field of ceiling suspension systems for absorbing sound energy. More particularly, some embodiments relate to acoustic panels that absorb sound energy in a ceiling suspension system.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
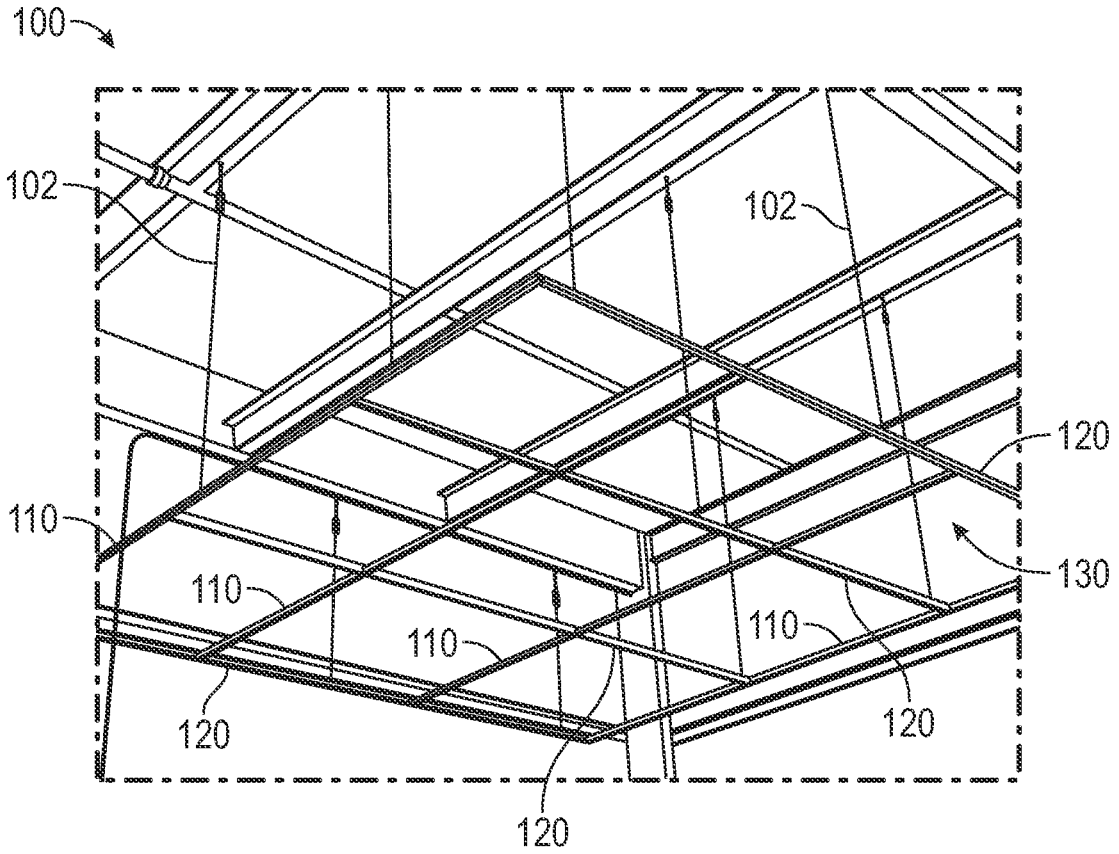
FIG. 1 illustrates a perspective view of a plurality of main runners and a plurality of cross runners of a ceiling suspension system according to one embodiment of the present disclosure.

Many locations are filled with various sources of sound and/or noise, including people, vehicles, music players, computers, televisions, appliances, musical instruments, etc. These sounds may cause confusions, strain, anxiety, privacy concerns, and/or miscommunication. Accordingly, sound dampening and/or acoustic materials may be used to absorb, dampen, reflect, etc., sound energy in an attempt to control the sound in a desired manner.

The present disclosure relates to acoustic mediums and methods for preparing acoustic mediums for absorbing, dampening, or reflecting sound energy. The embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method. Furthermore, the terms "comprise," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The phrase "coupled to" is broad enough to refer to any suitable coupling or other form of interaction between two or more entities, including mechanical interaction. Two components may be coupled to each other even though they are not in direct contact with each other. Objects described herein as being "adjacent" to each other may be in physical contact with each other, in close proximity to each other, or in the same general region or area as each other, as appropriate for the context in which the phrase is used.

FIG. 1 illustrates a perspective view of a ceiling suspension system 100. The ceiling suspension system 100 may be an exposed grid system or a concealed mounting system. The illustrated ceiling suspension system 100 includes a plurality of main runners 110 and a plurality of cross runners 120 that form a grid with a plurality of sections 130 or openings. The main runners 110 extend in a first direction and the cross runners 120 extend in a second direction that is different from the first direction. In some embodiments, the first direction and the second direction are substantially perpendicular to each other. Without limitation, the intersections between the main runners 110 and the cross runners 120 may form 4-foot by 4-foot sections 130 of a grid. However, the sections 130 may have a number of different dimensions, depending on certain criteria where the ceiling suspension system 100 will be installed. For instance, the intersections between the main runners 110 and the cross runners 120 may also be configured to form 1-foot by 1-foot sections 130 of a grid, up to 12-foot by 12-foot sections of a grid (e.g., 1 ft×1 ft, 2 ft×2 ft, 3 ft×3 ft, 4 ft×4 ft, 5 ft×5 ft, 6 ft×6 ft, 7 ft×7 ft, 8 ft×8 ft, 9 ft×9 ft, 10 ft×10 ft, 11 ft×11 ft, or 12 ft×12 ft). Smaller and/or larger grid sections 130 can also be formed. In other embodiments, the main runners 110 and the cross runners 120 are different lengths such that the grid sections 130 are not square shaped.

As shown in FIG. 1, the main runners 110 and the cross runners 120 may be suspended and/or hung from a ceiling or wall structure. For instance, in the illustrated embodiment, the main runners 110 and the cross runners 120 are suspended by a plurality of suspension wires or cables 102. The suspension wires or cables 102 support the main runners 110 and cross runners 120 at a predetermined distance from the ceiling. In other instances, the main runners 110 and the cross runners 120 are suspended by a wall structure (e.g., between two or more wall structures extending vertically from a floor structure).

Figure 2:
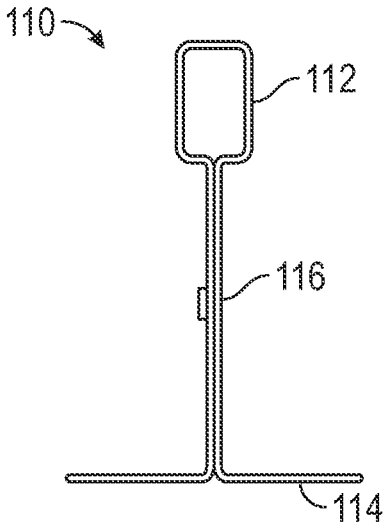
FIG. 2 illustrates a cross-sectional view of a main runner or a cross runner of the ceiling suspension system of FIG. 1.

FIG. 2 illustrates a cross-sectional view of one of the main runners 110. The cross runners 120 may have the same general cross-sectional shape of the main runners 110, but for ease of illustration, only the main runner 110 is illustrated. As illustrated, the main runner 110 comprises a bulb 112 that is formed on an upper portion or ridge of the main runner 110. The illustrated embodiment shows the bulb 112 with a rectangular cross-section. Other shapes are also contemplated. For example, in other embodiments, the cross-section of the bulb 112 may be triangular, round, circular, oval, polygonal, and the like. The bulb 112 may add structural load strength to the main runner 110. The main runner 110 further comprises a face 114 and a web 116 that extends between and couples the face 114 to the bulb 112. The face 114 may extend laterally as far as or farther than the bulb 112.

Figure 3:
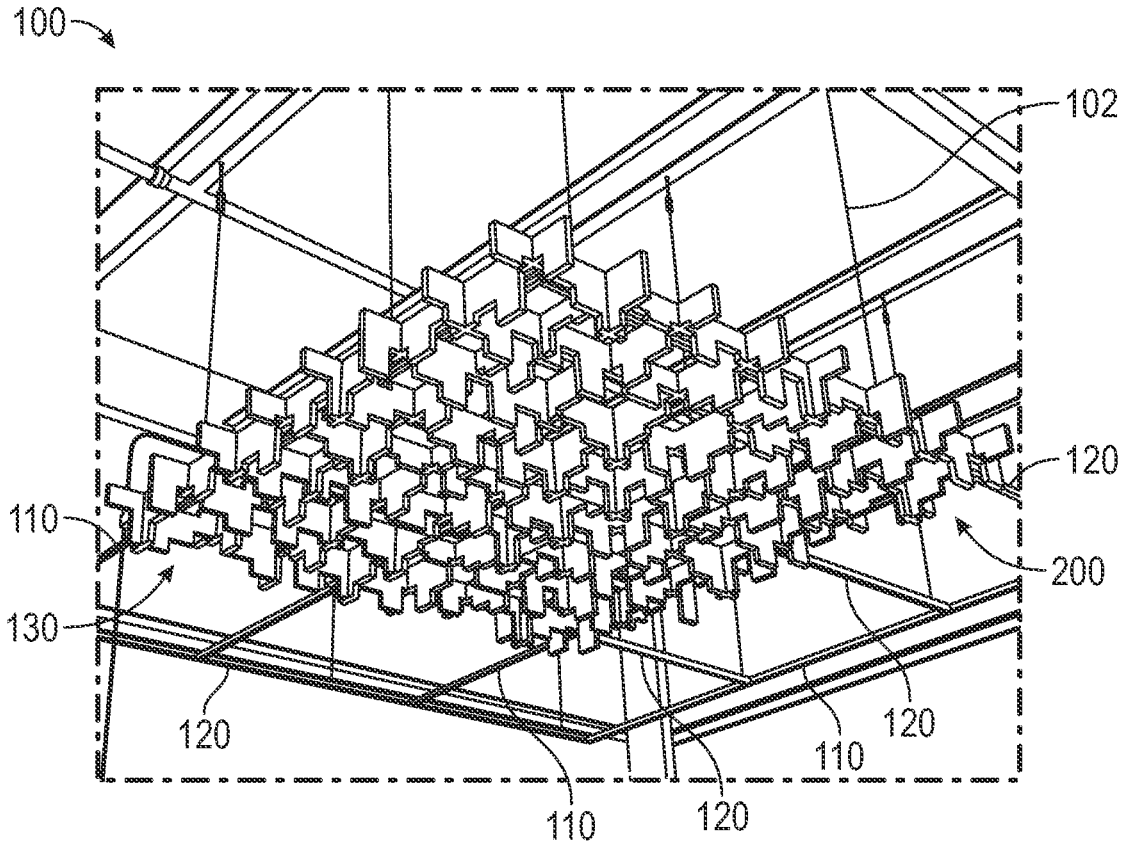
FIG. 3 illustrates a perspective view of a ceiling suspension system with a plurality of acoustic panels coupled to the main runners and cross runners of the ceiling suspension system.

FIG. 3 illustrates the ceiling suspension system 100 with a plurality of acoustic panels 200, each acoustic panel 200 installed into one of the sections 130 of the grid. Each acoustic panel 200 engages with a pair of main runners 110 and/or a pair of cross runners 120 that form each individual section 130. The ceiling suspension system 100 may be coupled directly to the ceiling, as illustrated in FIG. 3 via the suspension wires 102.

The acoustic panels 200 may interact with and/or couple to the main runner 110 and/or the cross runners 120 in a number of different ways. In the illustrated embodiment of FIG. 3, some of the acoustic panels 200 include cantilever portions that extend beyond the outer or peripheral main runners 110 and outer or peripheral cross runners 120. For example, a corner acoustic panel 300 can include cantilever portions on two of the peripheral edges of the acoustic panel 200 that extend beyond the outermost main runner 110 and the outermost cross runner 120 (see e.g., FIG. 9). A middle edge acoustic panel 400 can include a cantilever portion on a single edge of the middle edge acoustic panel 400 that extends beyond one of the outermost main runner 110 or the outermost cross runner 120 (see e.g., FIG. 10). A center acoustic panel 500 need not include cantilever portions on any of the edges of the center acoustic panel 500 (see e.g., FIG. 5). In other embodiments, all the acoustic panels can be configured as a center acoustic panel 500 without cantilever portions that extend beyond the main runner 110 or cross runner 120.

Figure 4:
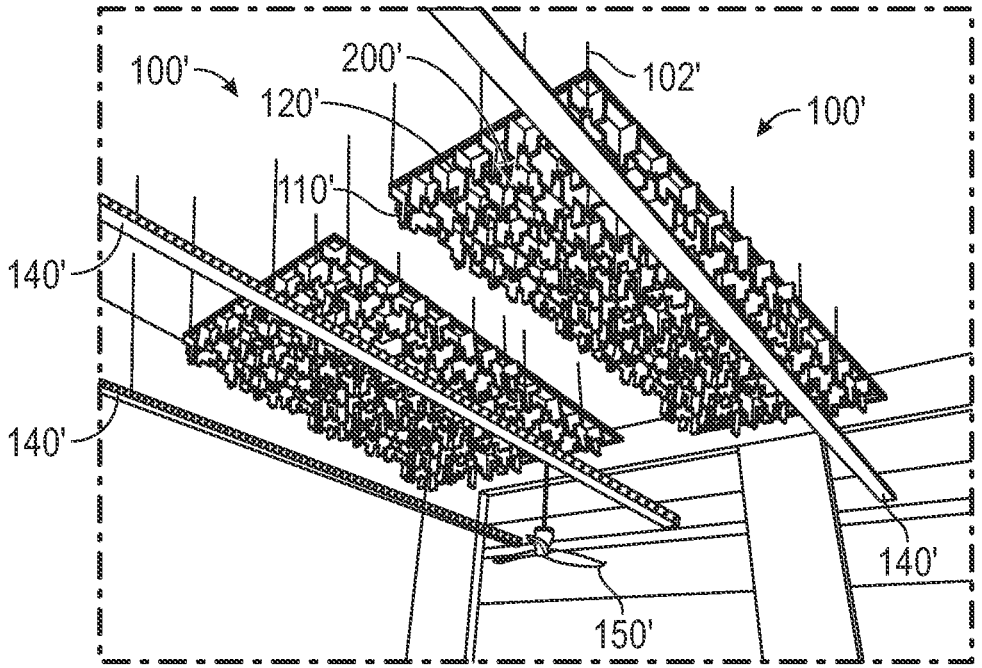
FIG. 4 illustrates another embodiment of a ceiling suspension system with a plurality of acoustic panels.

For example, FIG. 4 illustrates another embodiment of a ceiling suspension system 100' that is suspended via suspension wires 102'. In the illustrated embodiment, the ceiling suspension system 100' includes a plurality of acoustic panels 200' that do not have cantilever portions that overlap the main runners 110' or the cross runners 120'. In other words, all of the acoustic panels 200' are similar to the center acoustic panel 500 discussed previously in that the edges of the acoustic panels 200' couple to the main runners 110' and/or cross runners 120'. As illustrated in FIG. 4, the ceiling suspension system 100' may work in conjunction with lighting systems 140', ventilation systems 150', and the like.

With continued reference to FIG. 3, the acoustic panels 200 may be placed in the individual sections 130 of the ceiling suspension system 100 to absorb, dampen, and/or reflect sound energy. The acoustic panel 200 may comprise various types of sound dampening materials. Exemplary sound dampening materials that can be used include, but are not limited to, cotton, rayon, acetate, nylon, wood, olefins (or polyolefins), polyesters, acrylics, fiberglass, petroleum based fibers, biofibers (e.g., fibers manufactured from soy bean oil, corn oil, sugar cane, bamboo, etc.) and mixtures thereof. In certain embodiments, acoustic panel 200 comprises polyester and/or fiberglass. In a particular embodiment, acoustic panel 200 comprises polyester. And in another particular embodiment, the acoustic panel 200 comprises fiberglass. In certain embodiments, the sound dampening material is fibrous. For example, the acoustic panel 200 can comprise fiberglass, a spunbonded olefin, or a spunbonded polyester sound dampening material. In some embodiments, the fibrous material can also be an extruded fibrous material.

The sound dampening material of the acoustic panel 200, and/or the layers of acoustic panel 200, can also be non-woven. Non-woven materials can be useful in acoustic sound control due to their porous structure, high surface area, and low cost of production. The non-woven materials may also be porous. For example, non-woven materials can have a porosity greater than 70%, 80%, or 90%. This porosity can increase the amount of sound energy the acoustic panel 200 may absorb.

In some embodiments, the acoustic panel 200 comprises mixtures of different types of sound dampening materials (such as mixtures of different types of polyesters). For example, the acoustic panel 200 can comprise a high melt material and a low melt material (e.g., such as high and low melt polyesters). High melt materials can refer to materials having a melting point greater than about 330° F., such as between about 330° F. and about 450° F. Low melt materials can refer to materials having a melting point lower than about 320° F., such as between 220° F. and about 320° F. For instance, in a particular embodiment, the acoustic panel 200 comprises a mixture of at least one high melt polyester having a melting point greater than about 330° F., such as between about 330° F. and about 450° F., and at least one low melt polyester having a melting point lower than about 320° F., such as between 220° F. and about 320° F. In some of these embodiments, the acoustic panel 200 may comprise between about 50% and 95%, or between about 70% and 90% by weight of a high melt material, and between about 5% and 50%, or between about 10% and 30% by weight of a low melt material.

The acoustic panel 200 may also comprise acoustic materials having various weights, thicknesses, or deniers. For example, in certain embodiments, the acoustic materials can comprise a first portion of fibers having a first average denier and a second portion of fibers having a second average denier. In some of such embodiments, the first average denier is smaller than the second average denier. Additional sizes, such as a third average denier, fourth average denier, etc., can also be used.

As previously indicated, the acoustic panel 200 may be configured to absorb, dampen, and/or reduce acoustic energy. In some embodiments, the acoustic panel 200 may reduce acoustic energy by at least 20%, at least 30%, at least 40%, at least 50%, at least 60%, at least 70%, at least 80%, or at least 90%. In other embodiments, the acoustic panel 200 may reduce acoustic energy in an amount ranging from 50% to 90%. The standard for measuring such a reduction of acoustic energy may be a Noise Reduction Coefficient (NRC) as tested under ASTM C423 (2020 or 2021).

In some embodiments, the acoustic panel 200 can comprise a plurality of layers that are fabricated into a mat. In some of such embodiments, fabrication of the acoustic panel 200 comprises disposing acoustic material into two or more layers. The acoustic material can then be treated. For example, the acoustic material can be compressed and/or subjected to heat or elevated temperatures, such as with a hot iron or heat press to form a mat. Other manufacturing methods and/or processes can also be used. For example, in some embodiments, acoustic materials can be entangled within a layer. Entanglement can occur prior to laying the adjacent layer (e.g., second layer) or after laying the adjacent layer.

Figure 5:
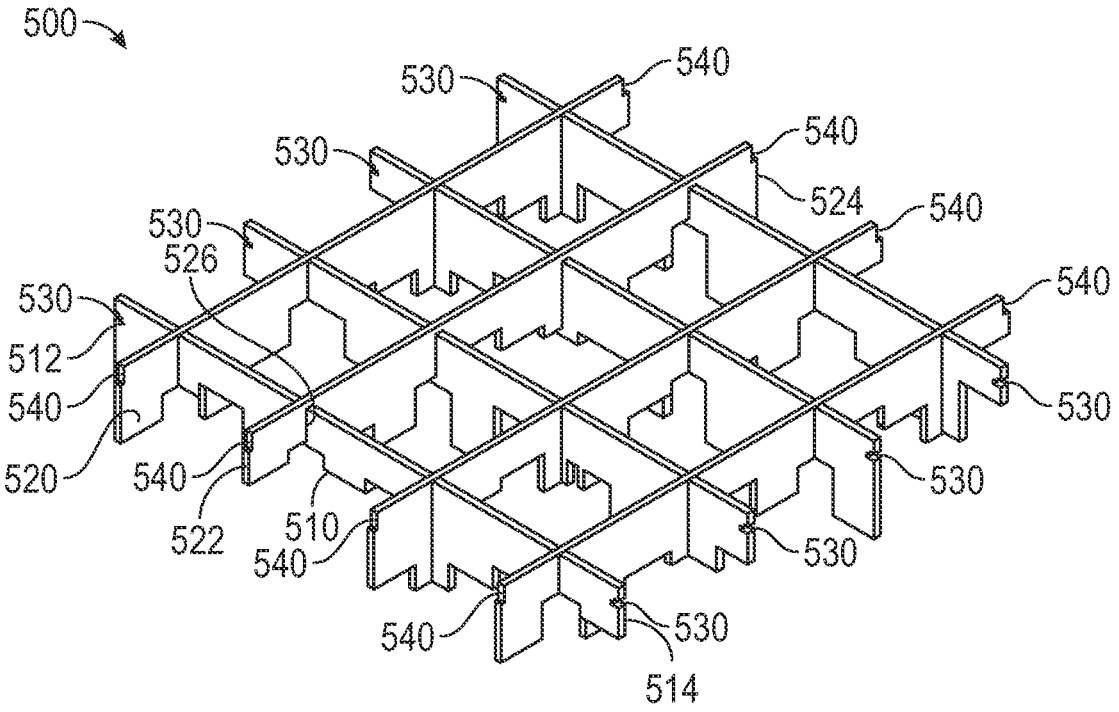
FIG. 5 illustrates a perspective view of an acoustic panel according to one embodiment of the present disclosure.

As discussed previously, the acoustic panels 200 may engage with the main runners 110 and the cross runners 120 in a number of different ways. FIG. 5 illustrates an exemplary embodiment of an acoustic panel that may be used in the ceiling suspension system 100. The acoustic panel in FIG. 5 may configured to be used as a center acoustic panel 500 in an embodiment that includes cantilevered edges (e.g., ceiling system 100 of FIG. 3), or it may be used as a center or edge acoustic panel 500 in an embodiment that does not include cantilevered edges (e.g., ceiling system 100' of FIG. 4).

The center acoustic panel 500 includes a plurality of main blades 510 and a plurality of cross blades 520. The main blades 510 may extend parallel in a first direction, and the cross blades 520 may extend parallel in a second direction. In some embodiments, the first direction and the second direction are substantially perpendicular, thus creating a grid with the main blades 510 and the cross blades 520. In some embodiments, the main blades 510 extend laterally past the outermost cross blades 520. Similarly, the cross blades 520 can extend laterally past the outermost main blades 510.

The acoustic panel 500 is configured such that it couples a pair of adjacent main runners 110 or a pair of adjacent cross runners 120. For example, the acoustic panel 500 may comprise a plurality of kerfs, cuts, or channels 530 that enable the acoustic panel 500 to be coupled to pair of main runners 110 or pair of cross runner 120. With reference to FIG. 5, for instance, a pair of kerfs 530 are disposed on the main runners 110. Specifically, each main blade 510 comprises a first kerf 530 that is disposed in a first lateral edge 512 and a second kerf 530 that is disposed in a second lateral edge 514 opposite the first lateral edge 512. Each kerf 530 is configured as a groove that enables the main blade 510 to couple to either the main runners 110 or the cross runners 120. In the embodiment of FIG. 5, the cross blades 520 do not comprise the same type of kerfs 530. Rather, the cross blades comprise cutouts 540 that are disposed on each of a first lateral edge 522 and a second lateral edge 524 opposite the first lateral edge 522. The cutouts 540 are configured to interact with either the main runners 110 or the cross runners 120 (whichever is not coupled to the main blades 510) but need not couple to it. For instance, the cutouts 540 can form a void in which the either the main runner 110 or the cross runner 120 (whichever is not coupled to the main blades 510) can be disposed.

The cross blades 520 may include a plurality of slots 526 disposed along the cross blades 520. The slots 526 enable the cross blades 520 to slide onto the top of the main blades 510. In some embodiments, the cross blades 520 may be coupled to the main blades 510 via a friction fit, adhesive, and the like.

The number of the main blades 510 and the number of the cross blades 520 may vary. The illustrated embodiment shows four main blades 510 and four cross blades 520; however, the present disclosure is not so limited and the center acoustic panel 500 may include more or less than four main blades 510 and four cross blades 520. The main blades 510 may also be equally spaced apart from an adjacent main blade 510; however, the main blades 510 may be unequally spaced for a different design. Similarly, the cross blades 520 may be equally spaced apart from an adjacent cross blade 520; however, the cross blades 520 may be unequally spaced for a different design.

As previously described, the kerfs 530 enable a user to couple the acoustic panel 500 into one of the sections 130 of the ceiling suspension system 100. With further reference to FIG. 5, at least two main blades 510 comprise kerfs for coupling to either adjacent main runners 110 or cross runners 120. In some embodiments, such as the illustrated acoustic panel 500, kerfs 530 are disposed on both lateral edges 512 and 514 of the main blade 510. In other embodiments discussed below, such as the acoustic panel 300 of FIG. 9 and the acoustic panel 400 of FIG. 10, one kerf 330, 430 is disposed on a lateral edge, and one kerf 350, 450 is disposed on an upper or top edge (which can create a cantilever portion).

Figure 6:
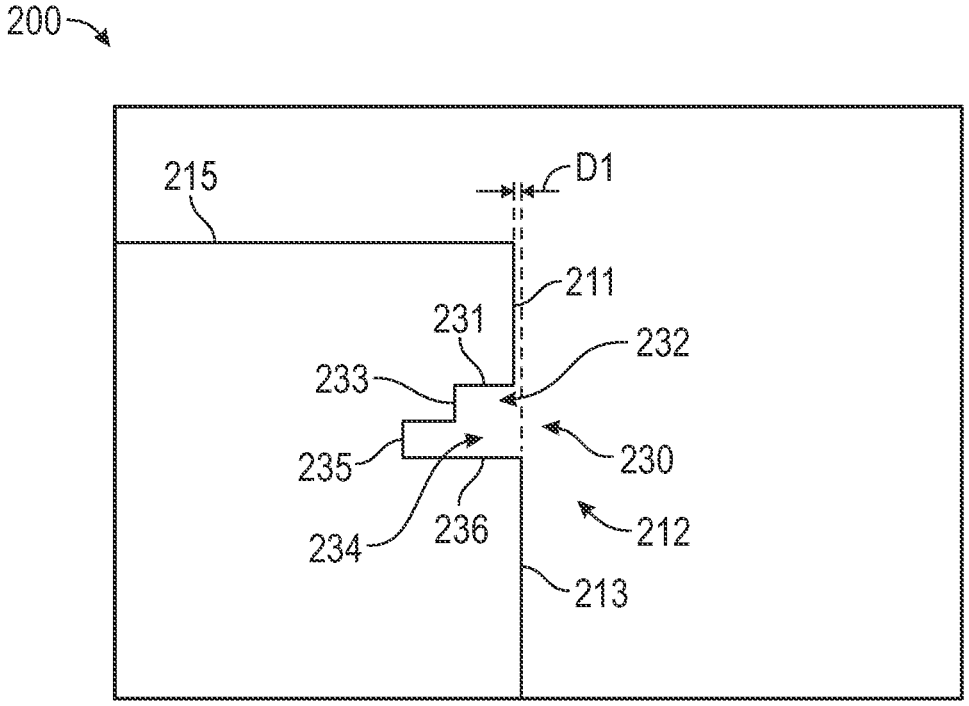
FIG. 6 illustrates a side view of a kerf disposed in a lateral edge of an acoustic panel.

FIG. 6 illustrates an exemplary kerf 230 of an acoustic panel 200. The kerf 230 described below is similar to the kerf 530 briefly discussed above. The kerf 230 is disposed in a lateral edge 212 of a blade of the acoustic panel 200 that accommodates the face 114 of the main runner 110 or the cross runner 120. The lateral edge 212 that comprises the kerf 230 includes an upper section 211 and a lower section 213. The lower section 213 of the lateral edge 212 is laterally offset from the upper section 211 a predetermined distance D1. In other words, the lower section 213 is disposed laterally outward relative to the upper section 211. In some embodiments, the upper section 211 and the lower section 213 are substantially parallel to each other. In some embodiments, the upper section 211 and the lower section 213 may be laterally offset from each other at a distance D1 that is less than about 0.3 inch, less than about 0.25 inch, less than about 0.2 inch, less than about 0.15 inch, or less than about 0.1 inch. In other embodiments, the upper section 211 and the lower section 213 may be laterally offset from each other at a distance that is between about 0.05 inch and about 0.3 inch, between about 0.05 inch and about 0.25 inch, between about 0.05 inch and about 0.2 inch, between about 0.05 inch and about 0.15 inch, or between about 0.1 inch and about 0.15 inch.

The illustrated kerf 230 of FIG. 6 comprises two slots, a first slot 232 (e.g., upper slot) and a second slot 234 (e.g., lower slot). The first slot 232 and the second slot 234 form a stepped shape kerf or groove 230. The stepped shape of the kerf 230 enables the kerf 230 to engage with the face 114 of either the main runner 110 or the cross runner 120. The first slot 232 comprises an upper surface 231 and a first lateral surface 233. The first lateral surface 233 is disposed at least 0.2 inch from the upper section 211 and not more than 0.5 inch from the upper section 211. In other words, the length of the upper surface 231 is between about 0.2 inch and about 0.5 inch. In another embodiment, the length of the upper surface 231 is between about 0.3 inch and about 0.5 inch, or between about 0.4 inch and about 0.5 inch.

The second slot 234 comprises a second lateral surface 235, a lower surface 236 and an upper surface 237. The second lateral surface 235 is disposed at least 0.5 inch from the lower section 213 and not more than 1 inch from the lower section 213. In other words, the length of the lower surface 236 is between about 0.5 inch and about 1 inch. In another embodiment, the length of the lower surface 236 is between about 0.6 inch and about 1 inch, between about 0.7 and about 1 inch, between about 0.8 inch and about 1 inch, or between about 0.9 inch and about 1 inch.

Figure 7A:
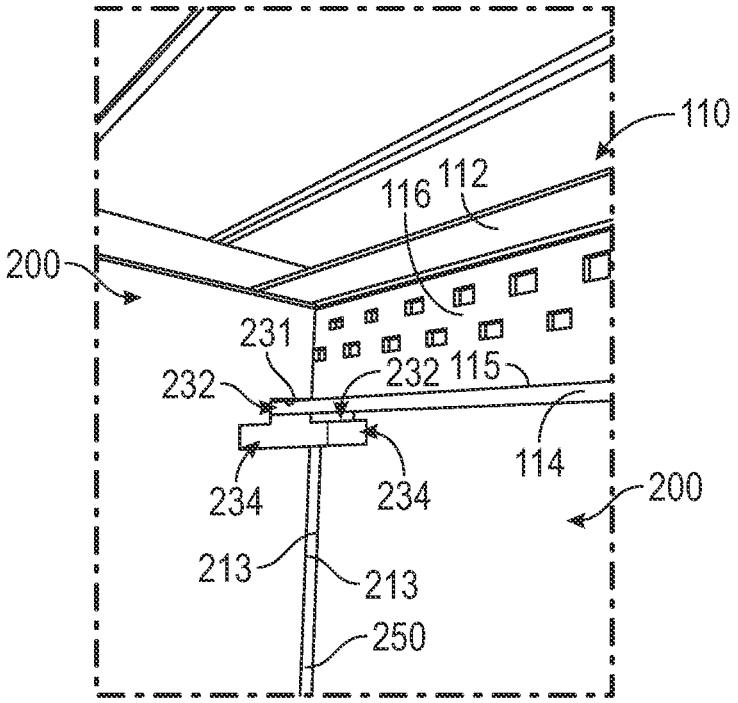
FIG. 7A illustrates a perspective view of two acoustic panels coupled to either a main runner or a cross runner of a ceiling suspension system according to one embodiment of the present disclosure.
Figure 7B:
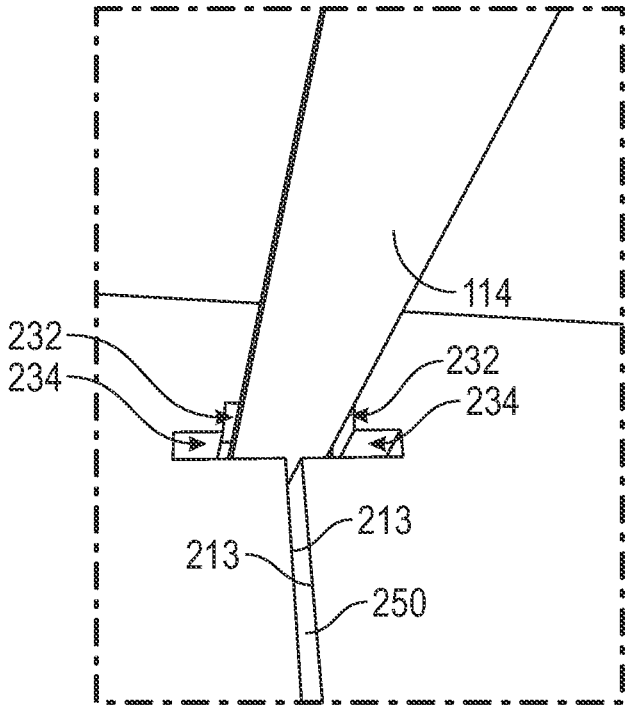
FIG. 7B illustrates another perspective view of two acoustic panels coupled to either a main runner or a cross runner of a ceiling suspension system.

In some embodiments, the kerf 230 is disposed at least 0.5 inch from an upper edge 215 of the acoustic panel 200. In other embodiments, the kerf 230 is disposed between about 0.5 inch and about 1.5 inch from the upper edge 215. The height of the kerf 230 may range between about 0.25 inch and about 1 inch. In some embodiments, the height of the first slot 232 and the height of the second slot 234 may be about 0.25 inch or more. In other words, the height of each of the first lateral surface 233 and the second lateral surface 235 can be 0.25 inch or more. In other embodiments, the height of each of the first lateral surface 233 and the second lateral surface can be between about 0.1 inch and about 0.5 inch, or between about 0.2 inch and about 0.3 inch FIGS. 7A and 7B illustrate perspective views of multiple acoustic panels 200 coupled to main runner 110. FIG. 7 is a side perspective view and FIG. 8 is a bottom perspective view of the acoustic panels 200 and the main runner 110. However, it will be appreciated that the acoustic panels 200 may be coupled to a cross runner 120 instead of the main runner 110 as desired. As discussed above, the main runner 110 comprises a bulb 112, a face 114, and a web 116 that extends from the bulb 112 to the face 114. The acoustic panels 200 each comprise a kerf 230 with a first slot 232 and a second slot 234. When the acoustic panel 200 is coupled to the main runner 110, the upper surface 231 of the first slot 232 of the kerf 230 is disposed or rests upon an upper surface 115 of the face 114. Similarly (although not shown), an opposite end of the acoustic panel blade can also comprise a kerf that is disposed upon an adjacent main runner 110. With two ends of the acoustic panel 200 coupled to adjacent main runners (or cross runners), the acoustic panels 200 can be suspended in place.

As shown in FIGS. 7A and 7B, the configuration of the kerf 230 can also enable a gap 250 between two lower edges 213 of adjacent acoustic panels 200 to be relatively small. A smaller gap 250 between adjacent acoustic panels 200 can be aesthetically pleasing and can also provide better acoustic capabilities. In some embodiments, the length of the acoustic panels 200 can be configured such that the gap 250 is minimized. For instance, the longitudinal length of the acoustic panel 200 at the lower section 213 (from one longitudinal end to the other longitudinal end) is between about 0.05 inch and about 0.3 inch, between about 0.05 inch and about 0.25 inch, between about 0.05 inch and about 0.2 inch, between about 0.05 inch and about 0.15 inch, or between about 0.1 inch and about 0.15 inch less than the opening 130 or space between runners 110 or cross runners 130. As an example, if the opening 130 or space between runners 110 or cross runners is about 48 inches (4 feet), then the longitudinal length of the acoustic panel 200 at the lower section 213 (from one longitudinal end to the other longitudinal end) is between about 47.7 inches and about 47.95 inches, between about 47.75 inches and about 47.95 inches, between about 47.8 inches and about 47.95 inches, between about 47.85 inches and about 47.95 inches, or between about 47.85 inches and about 47.9 inches. As another example, if the opening 130 or space between runners 110 or cross runners is about 24 inches (2 feet), then the longitudinal length of the acoustic panel 200 at the lower section 213 (from one longitudinal end to the other longitudinal end) is between about 23.7 inches and about 23.95 inches, between about 23.75 inches and about 23.95 inches, between about 23.8 inches and about 23.95 inches, between about 23.85 inches and about 23.95 inches, or between about 23.85 inches and about 23.9 inches. As another example, if the opening 130 or space between runners 110 or cross runners is about 36 inches (3 feet), then the longitudinal length of the acoustic panel 200 at the lower section 213 (from one longitudinal end to the other longitudinal end) is between about 35.7 inches and about 35.95 inches, between about 35.75 inches and about 35.95 inches, between about 35.8 inches and about 35.95 inches, between about 35.85 inches and about 35.95 inches, or between about 35.85 inches and about 35.9 inches. As yet another example, if the opening 130 or space between runners 110 or cross runners is about 60 inches (5 feet), then the longitudinal length of the acoustic panel 200 at the lower section 213 (from one longitudinal end to the other longitudinal end) is between about 59.7 inches and about 59.95 inches, between about 59.75 inches and about 59.95 inches, between about 59.8 inches and about 59.95 inches, between about 59.85 inches and about 59.95 inches, or between about 59.85 inches and about 59.9 inches. Similar acoustic panel 200 lengths are also contemplated in relation to other sized openings 130. In certain embodiments, the gap 250 between adjacent acoustic panels 200 can be between about 0.05 inch and about 0.2 inch, or between about 0.1 inch and about 0.15 inch. Further, in some of such instances, the longitudinal length of the acoustic panel 200 at the upper section 211 (from one longitudinal end to the other longitudinal end) is between about 0.15 inch and about 0.4 inch, between about 0.15 inch and about 0.35 inch, or between about 0.2 inch and about 0.3 inch less than the opening 130 or space between runners 110 or cross runners 130. Configuring the acoustic panel 200 in such a way can maximize the contact between the runners 110 or cross runners 130 and the upper resting surface 231 of the kerf 230 to provide a more secure installation and/or fit. The relatively small gap 250 also provides for a safer installation as the minimal gap 250 can help prevent adjacent acoustic panels 200 from shifting and/or falling out of position.

The configuration of the kerfs 230 also enables a user to couple and/or uncouple the acoustic panel 200 from the cross runners 120 (or main runners 110) as illustrated in the schematic diagrams of FIGS. 8A-8E. It will be appreciated that the schematic diagrams 8A-8E are not drawn to scale, but are illustrative of a method of installing an acoustic panel 200. As shown therein, the cross runners 120 comprise a bulb 122 that is formed on an upper portion or ridge of the cross runner 120, a face 124 and a web 126 that extends between and couples the face 124 to the bulb 122.

Figure 8A:
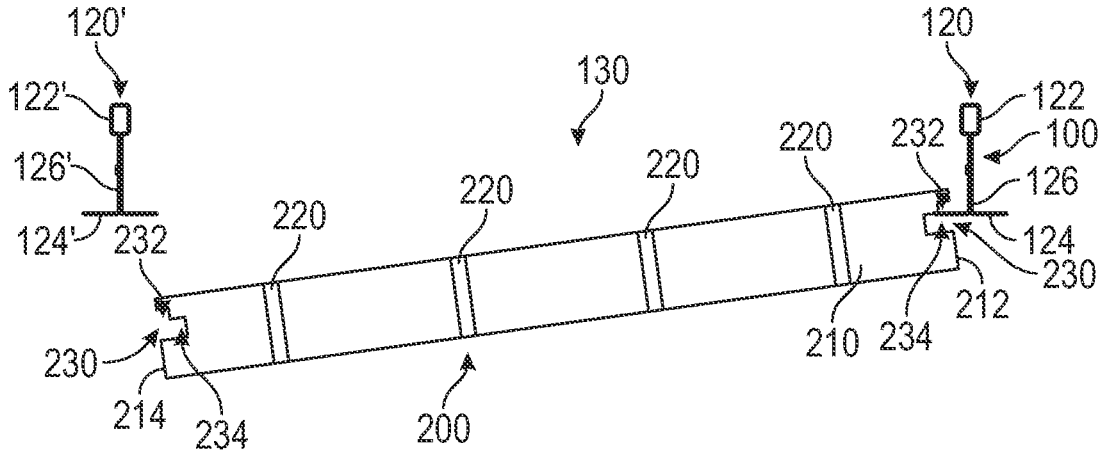
FIG. 8A illustrates installing an acoustic panel into a ceiling suspension system according to one embodiment of the present disclosure.

During installation or coupling, the acoustic panel 200 may be lifted into a section 130 of the ceiling suspension system 100 from the bottom or face 124 side of the cross runners 120. As illustrated in FIG. 8A, a user may lift and slide a first lateral edge 212 of the acoustic panel 200 such that the face 124 of a first cross runner 120 is disposed in each of the second slots 234 of the kerfs 230 of each of the main blades 210 (or cross blades 220) of the acoustic panel 200. As discussed above, the acoustic panel 200 may include multiple main blades 210.

Figure 8B:
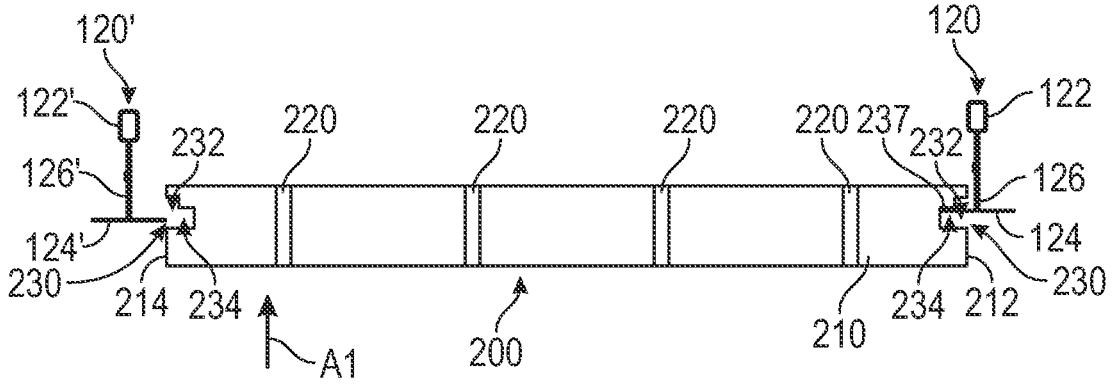
FIG. 8B illustrates installing the acoustic panel of FIG. 8A into the ceiling suspension system.

As illustrated in FIG. 8B, with the face 124 of the first cross runner 120 in the second slots 234, the user can lift a second lateral edge 214 of the acoustic panel 200 upward, as illustrated by arrow A1, and align the second kerfs 230 of the second lateral edge 214 with a second cross runner 120' (adjacent the previously mentioned first cross runner 120).

Figure 8C:
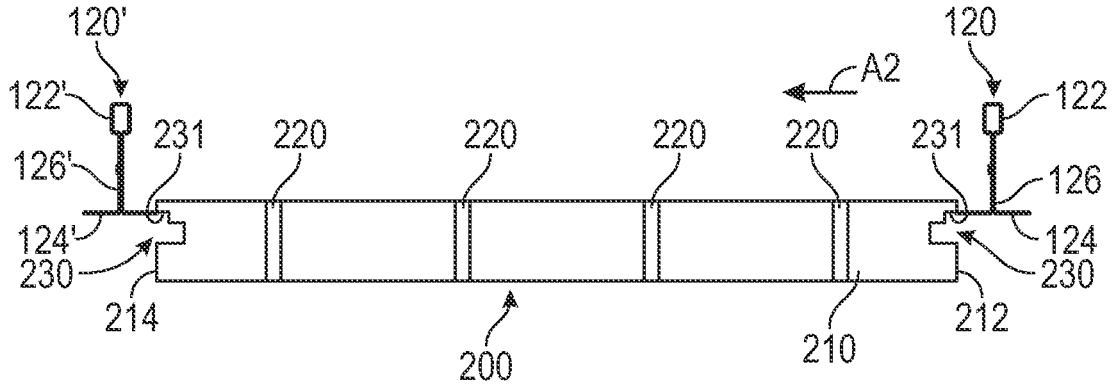
FIG. 8C illustrates the acoustic panel of 8A installed into the ceiling suspension system.

As illustrated in FIG. 8C, with the second kerfs 230 of the second lateral edge 214 aligned, the user may slide or shift the acoustic panel 200 towards the second cross runner 120' such that a face 124' of the second cross runner 120' is disposed in the first slots 232 of the kerfs 230 of the second lateral edge 214. In other words, the acoustic panel 200 may slide or shift in the direction illustrated by arrow A2. As the acoustic panel 200 is shifted or moved towards the second cross runner 120', the first lateral edge 212 of the acoustic panel 200 moves such that the face 124 of the first cross runner 110 transitions from the second slots 234 to the first slots 232 of the kerfs 230 on the first lateral edge 212. With adjacent runners 120, 120' disposed in the first slots 232 of first and second kerfs 230 (on opposite sides of the acoustic panel 200), the acoustic panel 200 can be described as being coupled to the cross runners 120, 120' and can remain in the suspended position.

Figure 8D:
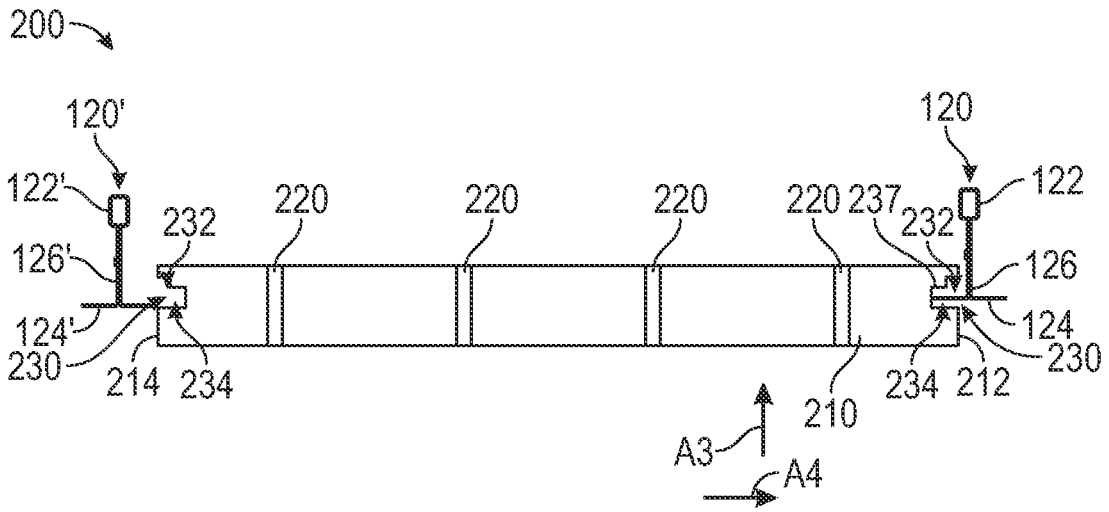
FIG. 8D illustrates removing the acoustic panel of 8A from the ceiling suspension system.
Figure 8E:
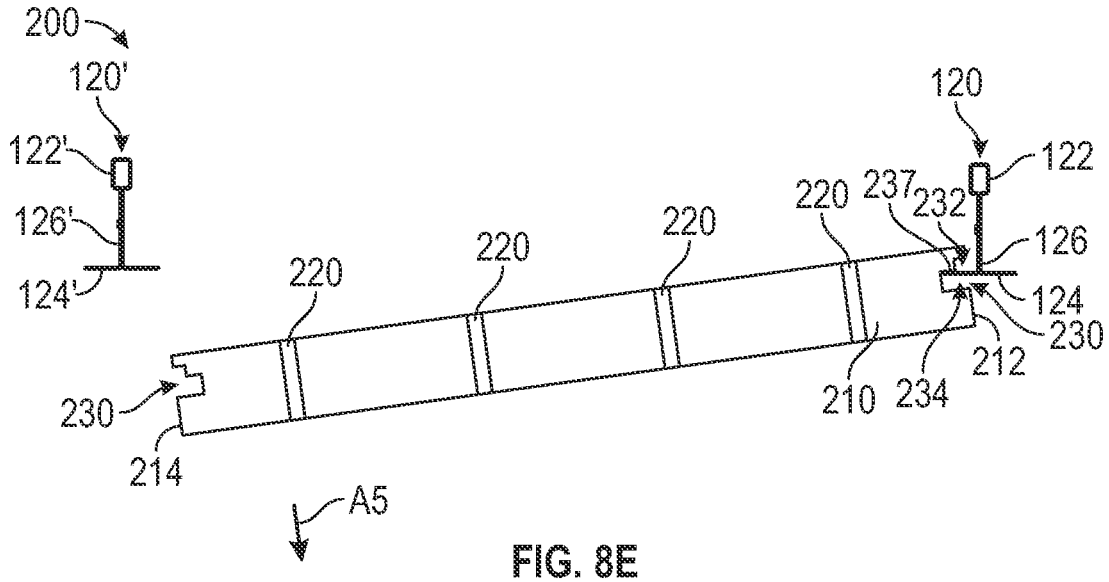
FIG. 8E illustrates removing the acoustic panel of 8A from the ceiling suspension system.

During removal, the user may lift the acoustic panel 200 and shift or slide the acoustic panel 200 towards a first runner 110 as shown in FIG. 8D and indicated by arrows A3 and A4. In doing so, the first lateral edge 212 of the acoustic panel 200 moves such that the face 124 of the first cross runner 120 transitions from the first slots 232 to the second slots of the kerfs 230 on the first lateral edge 212. The second lateral edge 214 of the acoustic panel 200 also moves such that the face 124' of the second cross runner 120' transitions from the first slots 232 of the kerfs 230 on the second lateral edge 214 to a position that no longer engages the acoustic panel 200 (e.g., a position outward from the first slots 232). The second lateral edge 214 of the acoustic panel 200 can then be lowered and removed from the section 130 of the ceiling suspension system 100, as illustrated in FIG. 8E and indicated by arrow A5. With the second lateral edge 214 of the acoustic panel 200 removed, the first lateral edge 212 of the acoustic panel 200 can also be slid and removed from the section 130 of the ceiling suspension system 100.

In certain embodiments, the main blades 210 (and/or cross blades 220) of the acoustic panel 200 can also be fabricated from a flexible material rather than a rigid material such that the user can bend the lateral edges of the main blades 210 (and/or cross blades 220) off a longitudinal axis of the main blades 210 (and/or cross blades 220), making it easier for the user to couple or uncouple the kerfs 230 of the main blades 210 (and/or cross blades 220) onto the runners 110. For instance, the main blades 210 (and/or cross blades 220) can bend when they are being and lifted and shifted into and/or out of the coupled position described above. The lateral width of the blades 210, 220 can also be between about 0.1 inch and about 3 inch, between about 0.1 inch and about 2.5 inch, or between about 0.1 inch and about 2 inch, which can help enable the blades 210, 220 to bend during insertion and/or removal.

Figure 9:
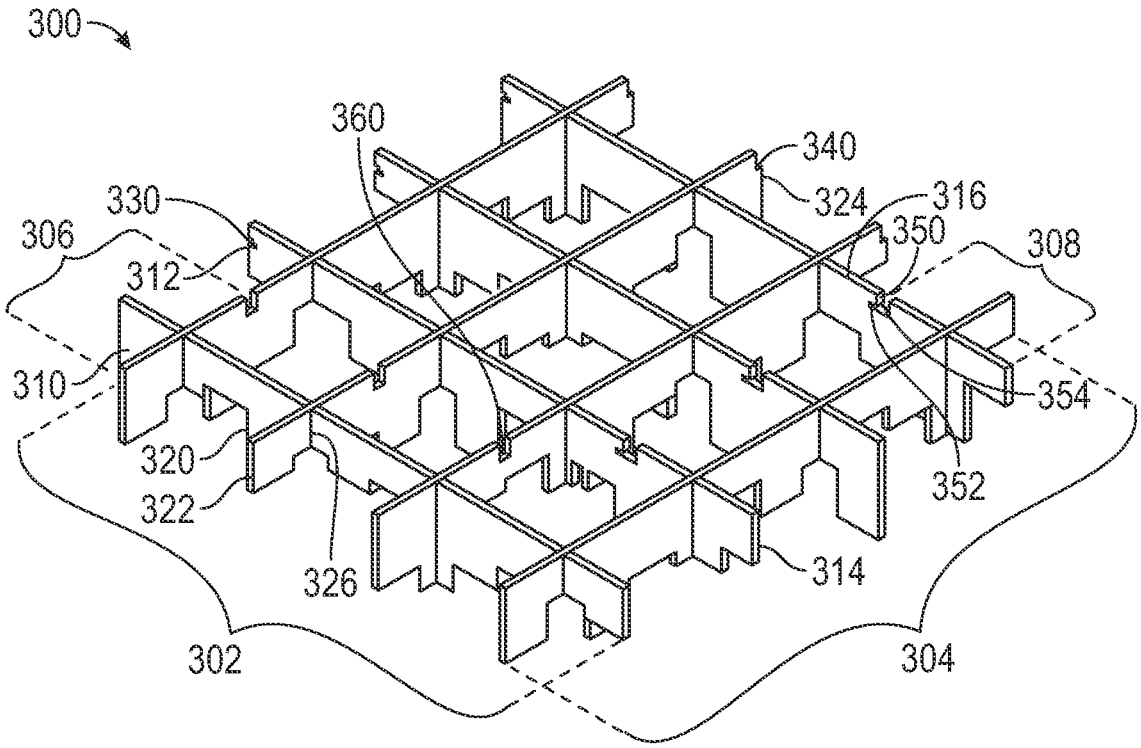
FIG. 9 illustrates a perspective view of an acoustic panel comprising a cantilever portion according to one embodiment of the present disclosure.

FIG. 9 illustrates a corner acoustic panel 300 according to another embodiment. The corner acoustic panel 300 is configured to be placed in a corner section of a grid of the ceiling suspension system 100. For figure simplification, the main runners 110 and the cross runners 120 are not illustrated in FIG. 9. The corner acoustic panel 300 includes a plurality of main blades 310 and a plurality of cross blades 320. The illustrated embodiment depicts the corner acoustic panel 300 with four main blades 310 and four cross blades 320; however, the present disclosure is not so limited and may include more or less than four main blades 310 and four cross blades 320. In some embodiments, the number of main blades 310 and cross blades 320 is equal. In other embodiments, there are more main blades 310 than cross blades 320. In further embodiments, there are more cross blades 320 than main blades 310. Each main blade 310 has a first lateral edge 312 and a second lateral edge 314 opposite the first lateral edge 312, and each cross blade 320 has a first lateral edge 322 and a second lateral edge 324 opposite the first lateral edge 322.

The cross blades 320 may also include a plurality of slots 326 disposed along the cross blades 320. The slots 326 enable the cross blades 320 to slide onto the top of the main blades 310. In some embodiments, the cross blades 320 may be coupled to the main blades 310 via a friction fit, adhesive, and the like.

As shown in FIG. 9, the corner acoustic panel 300 can include two cantilever portions 306, 308 on two of edges 302, 304 of the corner acoustic panel 300 that are configured to extend beyond the outermost main runner 110 and the outermost cross runner 120. Due to the cantilever portions 306, 308 of the corner acoustic panel 300, the locations of kerfs 330 for attaching the corner acoustic panel 300 to the ceiling suspension system 100 are disposed in different locations than the acoustic panel 500 previously discussed. For example, the kerfs 330 are disposed in the first lateral edge 312 of only some of the main blades 310 and cross runners 320. Specifically, in the illustrated embodiment, the kerfs 330 are disposed in three of the main blades 310, but not in the main blade 310 of the cantilever portion 306 that is disposed on the outermost edge 302 of the corner acoustic panel 300.

Further, there are no kerfs 330 disposed in the second lateral edge 314 of the main blades 310. Instead, some of the main blades 310 may comprise kerf slots 350. The kerf slots 350 are configured to couple to the outermost main runner 110 or the outermost cross runner 120. The kerf slots 350 extend downward from a top edge 316 of the main blade 310 and comprise a slot 352 that extends toward the first lateral edge 312 of the main blade 310 on a first lateral side 354 of the kerf slot 350. The kerf slot 350 may be disposed at a beginning of the cantilever portion 308 that extends beyond either the main runner 110 or the cross runner 120. In the illustrated embodiment, the kerf slots 350 are disposed in three of the main blades 310, but not in the outermost main blade 310 in the cantilever portion 306 in the edge 302 of the corner acoustic panel 300.

The kerf slots 350 may function similar to kerfs 330 during the installation and/or removal process. For example, during installation or coupling, an acoustic panel 300 may be lifted into a section 130 of the ceiling suspension system 100 from the bottom or face 114 side of the runners 110. In doing so, a user may lift and slide a first side of the acoustic panel 300 such that a face 114 of a first runner 110 is disposed in the second slots of first kerfs 330 of the main blades 310. With the face 114 of the first runner 110 in the second slots, the user can lift the second side of the acoustic panel 300 (opposite the first side) such that the second runner 110 is disposed in the kerf slots 350 and aligned with the slots 352 of the kerf slots 350. With the slots 350 aligned, the user may slide or shift the acoustic panel 300 towards the second runner 110 such that a face 114 of the second runner 110 is disposed in the slots 352 of the kerfs slots 350. As the acoustic panel 300 is shifted or moved towards the second runner 110, the first side of the acoustic panel 300 moves such that the face 114 of the first runner 110 transitions from the second slots to the first slots of the first kerfs 330. With the adjacent runners 100 disposed in the first slots of the first kerfs 330 and the slots 352 of the kerf slots 230 (on opposite sides of the acoustic panel 300), the acoustic panel 300 can be described as being coupled to the runners 110 and can remain in the suspended position. The cantilevered portion 308 also overhangs and is cantilevered beyond the runners 110.

The cross blades 320 may comprise a cutout 340 that is disposed on a second lateral edge 324. The cutout 340 is configured to accommodate the main runners 110 or the cross runners 120. In the illustrated embodiment, the cutouts 340 are disposed in three of the cross blades 320, but not in the cross blade 320 in the cantilever portion 308 on the edge 304. Further, there are no cutouts 340 in the first lateral edge 322 of the cross blade 320. Instead, some of the cross blades 320 comprise a second cutout 360 that is disposed at a beginning of the cantilever portion 306. The second cutout 360 may be rectangular shaped and accommodate the outermost main runner 110 or the outermost cross runner 120. In the illustrated embodiment, the second cutouts 360 are disposed in three of the cross blades 320, but not in the cross blade 320 in the cantilever portion 308 on the edge 304. The first and second cutouts 340, 360 can be configured to receive and accommodate cross runners 120 (or main runners 110), but are not configured to be suspended from the cross runners 120 (or main runners 110).

Figure 10:
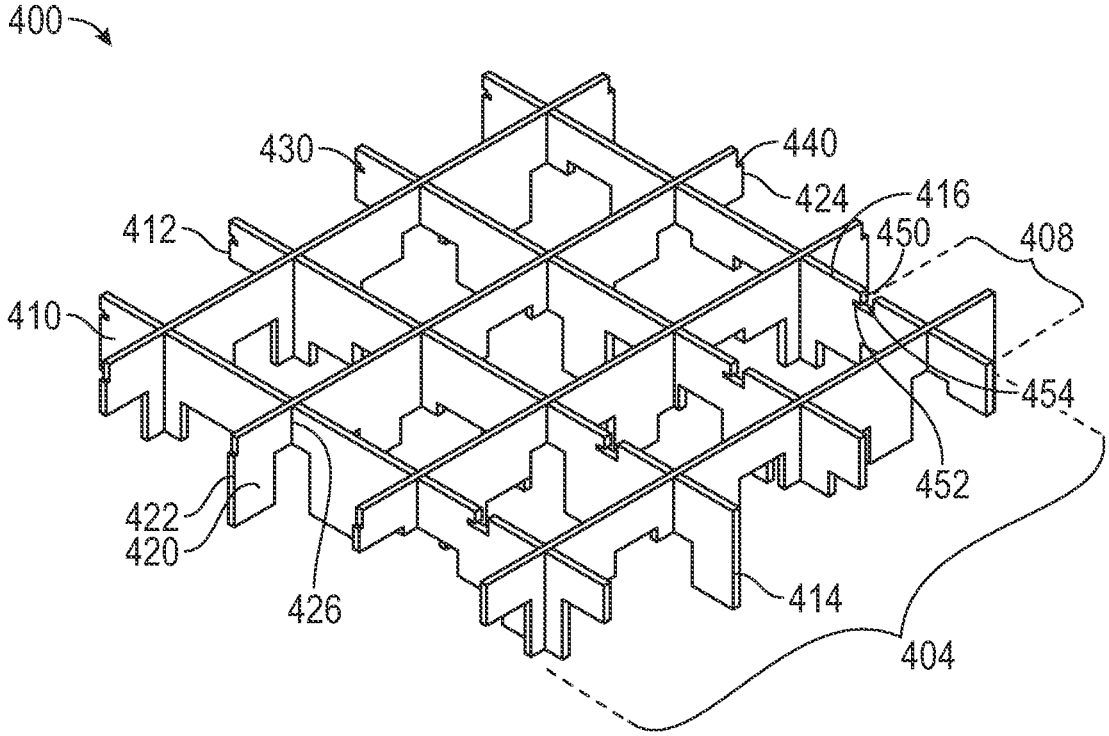
FIG. 10 illustrates a perspective view of an acoustic panel comprising a cantilever portion according to another embodiment of the present disclosure.

FIG. 10 illustrates the middle edge acoustic panel 400 according to another embodiment. The middle edge acoustic panel 400 is configured to be placed in between corner acoustic panels 300 in the ceiling suspension system 100. In some embodiments, there may be multiple middle edge acoustic panels 400 disposed between the corner acoustic panels 300. For figure simplification, the main runners 110 and the cross runners 120 are not illustrated in FIG. 10. The middle edge acoustic panel 400 includes a plurality of main blades 410 and a plurality of cross blades 420. The illustrated embodiment illustrates the middle edge acoustic panel 400 with four main blades 410 and four cross blades 420; however, the present disclosure is not so limited and may include more or less than four main blades 410 and four cross blades 420. In some embodiments, the number of main blades 410 and cross blades 420 is equal. In some embodiments, there are more main blades 410 than cross blades 420. In some embodiments, there are more cross blades 420 than main blades 410. Each main blade 410 has a first lateral edge 412 and a second lateral edge 414 opposite the first lateral edge 412, and each cross blade 420 has a first lateral edge 422 and a second lateral edge 424 opposite the first lateral edge 422.

The cross blades 420 may include a plurality of slots 426 disposed along the cross blades 420. The slots 426 enable the cross blades 420 to slide onto the top of the main blades 410. In some embodiments, the cross blades 420 may be coupled to the main blades 410 via a friction fit, adhesive, and the like.

The middle edge acoustic panel 400 includes a cantilever portion 408 on an edge 404 of the middle edge acoustic panel 400 that extends beyond the outermost main runner 110 (or outermost cross runner 120). Due to the cantilever portion 408 of the middle edge acoustic panel 400, the locations of kerfs 430 for attaching the middle edge acoustic panel 400 to the ceiling suspension system 100 are disposed in different locations than the center acoustic panel 500.

For example, some kerfs 430 may be disposed in the first lateral edge 412 of the main blades 410. And there are no kerfs 430 disposed in the second lateral edge 414 of the main blades 410. Instead the main blades 410 may comprise kerf slots 450. The kerf slots 450 are configured to couple to the main runner 110 or the cross runner 120. The kerf slots 450 extend downward from a top edge 416 of the main blade 410 and comprise a slot 452 that extends toward the first lateral edge 412 of the main blade 410 on a first lateral side 454 of the kerf slot 450. The kerf slot 450 may be disposed at a beginning of the cantilever portion 408 that extends beyond either the main runner 110 or the cross runner 120.

The cross blades 420 may comprise a cutout 440 disposed both on a first lateral edge 422 and on a second lateral edge 424. The cutout 440 is configured to accommodate the main runners 110 or the cross runners 120. In the illustrated embodiment, the cutouts 440 are disposed in three of the cross blades 420, but not in the cross blade 420 in the cantilever portion 408 on the edge 404.

Figure 11:
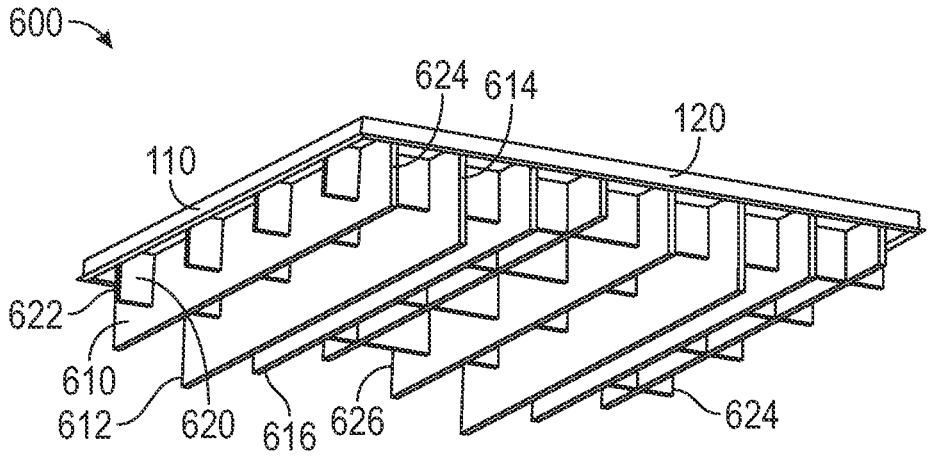
FIG. 11 illustrates a perspective view of an acoustic panel according to another embodiment of the present disclosure.

It will be appreciated that the present disclosure is not limited to the designs of the acoustic panel illustrated in FIGS. 1-10. FIG. 11-15 illustrate additional designs of acoustic panels that fall within the scope of the present invention. The acoustic panels illustrated in FIGS. 11-14 are similar to the acoustic panels described in FIGS. 1-10 in the way that the acoustic panels are coupled to the main runners 110 and the cross runners 120. However, the acoustic panels have different bottom edges of the main blades and the cross blades. Each design is designed for acoustic purposes to absorb sound waves that hit them to reduce the intensity and echo. FIG. 11 illustrates an acoustic panel 600 comprising a plurality of main blades 610 and a plurality of cross blades 620 that are configured to couple to the main runner 110 and the cross runner 120. In the illustrated embodiment, there are eight main blades 610 and four cross blades 620; however, the present disclosure is not so limited, and there may be more or less main blades 610 and cross blades 620. The main blades 610 have a flat bottom edge 616 that extends from a first lateral edge 612 to a second lateral edge 614. The main blades 610 may have different heights. The cross blades 620 have a flat bottom edge 626 that extends from a first lateral edge 622 to a second lateral edge 624. Each of the cross blades 620 has the same height.

Figure 12:
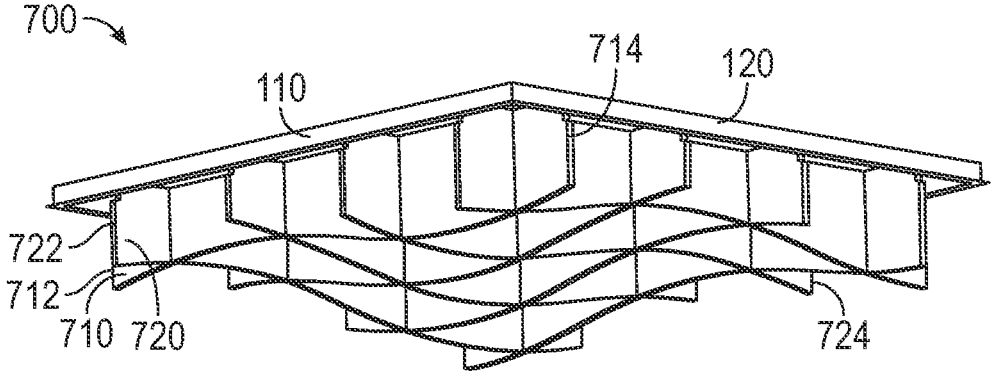
FIG. 12 illustrates a perspective view of an acoustic panel according to another embodiment of the present disclosure.

FIG. 12 illustrates an acoustic panel 700 comprising a plurality of main blades 710 and a plurality of cross blades 720 that are configured to couple to the main runner 110 and the cross runner 120. In the illustrated embodiment, there are four main blades 710 and four cross blades 720; however, the present disclosure is not so limited, and there may be more or less main blades 710 and cross blades 720. The main blades 710 may have a wave shaped configuration that extends from a first lateral edge 712 to a second lateral edge 714, wherein the height of the main blade 710 changes over the length of the main blade 710. Each main blade 710 may have a different wave pattern configuration. The cross blades 720 may have a wave shaped configuration that extends from a first lateral edge 722 to a second lateral edge 724, wherein the height of the cross blade 720 changes over the length of the cross blade 720. Each cross blade 720 may have a different wave pattern configuration.

Figure 13:
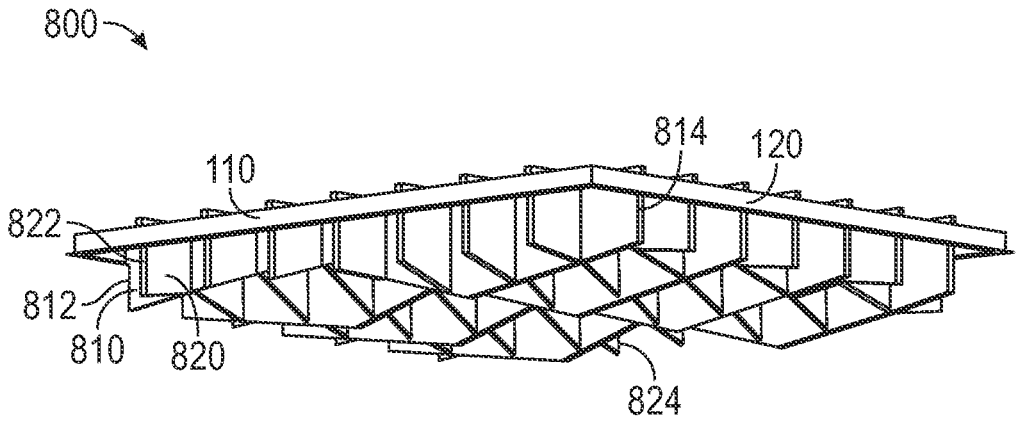
FIG. 13 illustrates a perspective view of an acoustic panel according to another embodiment of the present disclosure.

FIG. 13 illustrates an acoustic panel 800 comprising a plurality of main blades 810 and a plurality of cross blades 820 that are configured to couple to the main runner 110 and the cross runner 120. In the illustrated embodiment, there are seven main blades 810 and seven cross blades 820; however, the present disclosure is not so limited, and there may be more or less main blades 810 and cross blades 820. The main blades 810 may have an angled configuration that changes direction multiple times as the main blade 810 extends from a first lateral edge 812 to a second lateral edge 814. The height of the main blade 810 changes over the length of the main blade 810. Each main blade 810 may have a different angled configuration. The cross blades 820 may have an angled configuration that changes direction multiple times as the cross blade 820 extends from a first lateral edge 822 to a second lateral edge 824. The height of the cross blade 820 changes over the length of the cross blade 820. Each cross blade 820 may have a different angled configuration.

Figure 14:
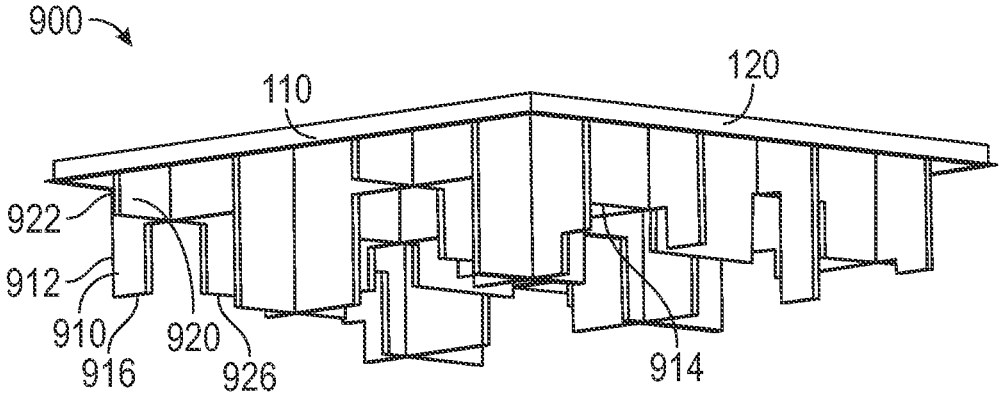
FIG. 14 illustrates a perspective view of an acoustic panel according to another embodiment of the present disclosure.

FIG. 14 illustrates an acoustic panel 900 comprising a plurality of main blades 910 and a plurality of cross blades 920 that are configured to couple to the main runner 110 and the cross runner 120. In the illustrated embodiment, there are four main blades 910 and four cross blades 920; however, the present disclosure is not so limited, and there may be more or less main blades 910 and cross blades 920. A bottom edge 916 of the main blades 910 may change heights over the length from a first lateral edge 912 to a second lateral edge of the 914. The bottom edge 916 of each main blade 910 may have a different design. A bottom edge 926 of the cross blades 920 may change heights over the length from a first lateral edge 922 to a second lateral edge (not shown). The bottom edge 926 of each cross blade 920 may have a different design.

Figure 15:
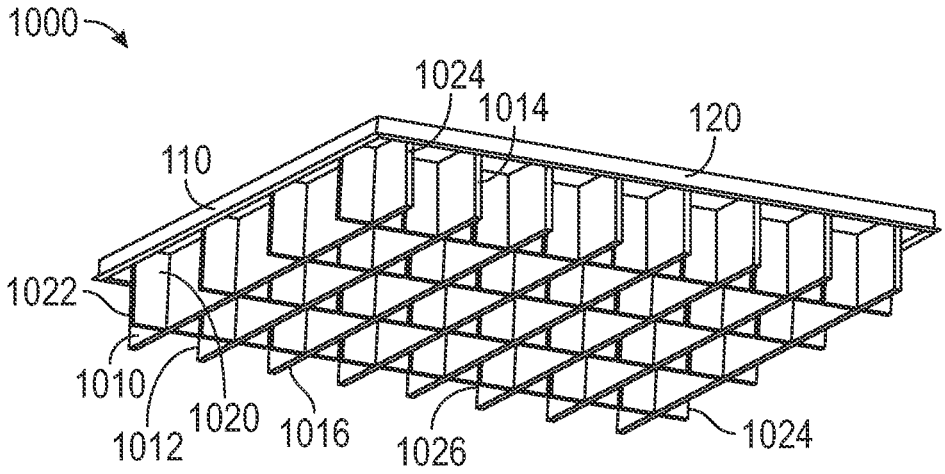
FIG. 15 illustrates a perspective view of an acoustic panel according to another embodiment of the present disclosure.

FIG. 15 illustrates an acoustic panel 1000 comprising a plurality of main blades 1010 and a plurality of cross blades 1020 that are configured to couple to the main runner 110 and the cross runner 120. In the illustrated embodiment, there are four main blades 1010 and four cross blades 1020; however, the present disclosure is not so limited, and there may be more or less main blades 1010 and cross blades 1020. The main blades 1010 may have a flat bottom edge 1016 that extends from a first lateral edge 1012 to a second lateral edge 1014. Each of the main blades 1010 has the same height. The cross blades 1020 have a flat bottom edge 1026 that extends from a first lateral edge 1022 to a second lateral edge 1024. Each of the cross blades 1020 has the same height. In the illustrated embodiment of FIG. 15, each of the main blades 1010 and each of the cross blades 1020 also have the same height.

Methods of using and/or making an acoustic system are also disclosed herein. In particular, it is contemplated that any of the components, principles, and/or embodiments discussed above may be utilized in either an acoustic system or a method of using and/or making the same.

It will be appreciated that any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

The invention claimed is:

1. A ceiling suspension system comprising:

a plurality of main runners that extend parallel to each other in a first direction;

a plurality of cross runners that extend parallel to each other in a second direction, wherein the first direction and the second direction are substantially perpendicular, and wherein the plurality of main runners and cross runners form a grid with a plurality of openings; and a plurality of acoustic panels configured to couple to the main runners within one of the plurality of openings, the plurality of acoustic panels comprising:

a plurality of main blades that extend parallel to each other in the first direction; and a plurality of cross blades that extend parallel to each other in the second direction, wherein the first direction is different from the second direction, and wherein the plurality of main blades and the plurality of cross blades form a grid, wherein two or more of the main blades comprise a kerf disposed in a first lateral edge of the main blade, wherein the kerf disposed in the first lateral edge is configured to engage with one of the main runners, and wherein the kerf comprises a first slot and a second slot that form a stepped configuration, wherein the first slot is disposed above the second slot, and wherein the second slot extends further into the main blade from the first lateral edge than the first slot, and wherein two or more of the cross blades comprise a cutout that is disposed in a first lateral edge of the cross blade and extends downward from an upper edge of the cross blade, and wherein the cutout disposed in the first lateral edge is configured to accommodate one of the cross runners.

2. The ceiling suspension system of claim 1, wherein two or more of the main blades comprise a kerf disposed in a second lateral edge of the main blade, wherein the second lateral edge is on an opposite end than the first lateral edge, and the kerf disposed in the second lateral edge is configured to engage with one of the main runners.

3. The ceiling suspension system of claim 2, wherein all of the main blades of the plurality of main blades comprise the kerf in the first lateral edge and in the second lateral edge.

4. The ceiling suspension system of claim 1, wherein the second slot extends inward from the first lateral edge a length that is at least double the length the first slot extends inward from the first lateral edge.

5. The ceiling suspension system of claim 1, wherein the first lateral edge comprises an upper edge and a lower edge, wherein the upper edge is disposed above the kerf and the lower edge is disposed below the kerf, and wherein the upper edge is inwardly offset and parallel from the lower edge.

6. The ceiling suspension system of claim 1, wherein the kerf is disposed between 0.5 inch and 2 inches from a top surface of the main blade.

7. The ceiling suspension system of claim 1, wherein at least one of the acoustic panels comprises at least one cantilever portion along an edge of the acoustic panel, and wherein the cantilever portion is configured to extend beyond a main runner of the plurality of main runners.

8. The ceiling suspension system of claim 7, wherein the two or more of the main blades comprising the kerf disposed in the first lateral edge further comprise a kerf slot that is configured to couple to a main runner of the plurality of main runners, wherein the kerf slot extends downward from an upper surface of the main blade and comprises a slot that extends toward the first lateral edge, and wherein the kerf slot is disposed a predetermined distance from the second lateral edge.

9. The ceiling suspension system of claim 1, wherein at least one of the acoustic panels comprises at least two cantilever portions along different edges of the acoustic panel, wherein the edges are adjacent and substantially perpendicular to each other, and wherein the cantilever portions are configured to extend beyond a main runner of the plurality of main runners and a cross runner of the plurality of cross runners.

10. The ceiling suspension system of claim 1, wherein the cutout does not couple to the cross runner.

11. The ceiling suspension system of claim 1, wherein the two or more of the cross blades comprise a cutout that is disposed in a second lateral edge of the cross blade and extends downward from an upper edge of the cross blade, wherein the second lateral edge is on an opposite end than the first lateral edge, and wherein the cutout disposed in the second lateral edge is configured to accommodate with one of the cross runners.

12. An acoustic panel configured to couple to a ceiling suspension system, the acoustic panel comprising:

a plurality of main blades that extend parallel to each other in a first direction; and a plurality of cross blades that extend parallel to each other in a second direction, wherein the first direction is different from the second direction, and wherein the plurality of main blades and the plurality of cross blades form a grid, wherein two or more of the main blades comprise a kerf disposed in a first lateral edge of the main blade, and wherein the kerf comprises a first slot and a second slot that form a stepped configuration, wherein the first slot is disposed above the second slot, and wherein the second slot extends further into the main blade from the first lateral edge than the first slot, and wherein two or more of the cross blades comprise a cutout that is disposed in a first lateral edge of the cross blade and extends downward from an upper edge of the cross blade.

13. The acoustic panel of claim 12, wherein the first direction is substantially perpendicular to the second direction.

14. The acoustic panel of claim 12, wherein the second slot extends inward from the first lateral edge a length that is at least double the length the first slot extends inward from the first lateral edge.

15. The acoustic panel of claim 12, wherein the first lateral edge comprises an upper edge and a lower edge, wherein the upper edge is disposed above the kerf and the lower edge is disposed below the kerf, and wherein the upper edge is inwardly offset and parallel from the lower edge.

16. The acoustic panel of claim 12, wherein all of the main blades of the plurality of main blades comprise the kerf in the first lateral edge and in the second lateral edge.

17. The acoustic panel of claim 12, wherein the two or more of the main blades comprising the kerf disposed in the first lateral edge further comprise a kerf slot that is configured to couple to a main runner of a plurality of main runners, wherein the kerf slot extends downward from an upper surface of the main blade and comprises a slot that extends toward the first lateral edge, and wherein the kerf slot is disposed a predetermined distance from the second lateral edge.

18. An acoustic panel configured to couple to a ceiling suspension system, the acoustic panel comprising:

a plurality of main blades that extend parallel to each other in a first direction; and a plurality of cross blades that extend parallel to each other in a second direction, wherein the first direction is different from the second direction, and wherein the plurality of main blades and the plurality of cross blades form a grid, wherein two or more of the main blades comprise a kerf disposed in a first lateral edge of the main blade, wherein the kerf comprises a first slot and a second slot that form a stepped configuration, wherein the first slot is disposed above the second slot, wherein the second slot extends further into the main blade from the first lateral edge than the first slot, wherein the first lateral edge comprises an upper edge and a lower edge, wherein the upper edge is disposed above the kerf and the lower edge is disposed below the kerf, and wherein the upper edge is inwardly offset and parallel from the lower edge, and wherein two or more of the cross blades comprise a cutout that is disposed in a first lateral edge of the cross blade and extends downward from an upper edge of the cross blade.

* * * * *